US005345654A

United States Patent [19]

Ferrari et al.

[11] Patent Number: 5,345,654

[45] Date of Patent: Sep. 13, 1994

[54] QUICK-COUPLING WING TYPE HINGE AND BASE

[75] Inventors: Franco Ferrari, Localitá Deviscio, 22053 Lecco, Italy; Carlo Migli, Lecco, Italy

[73] Assignee: Franco Ferrari, Lecco, Italy

[21] Appl. No.: 993,423

[22] Filed: Dec. 21, 1992

[51] Int. Cl.[5] ..... E05D 11/00; E05D 7/12; E05D 5/00

[52] U.S. Cl. ..... 16/251; 16/272; 16/382

[58] Field of Search ..... 16/254, 271, 272, 250, 16/251, 382, DIG. 43

[56] References Cited

U.S. PATENT DOCUMENTS

| | | | |
|---|---|---|---|
| 4,800,625 | 1/1989 | Salice | 16/382 |
| 4,847,948 | 7/1989 | Gross et al. | 16/251 |
| 4,856,141 | 8/1989 | Sassenberg | 16/251 |
| 5,025,530 | 6/1991 | Ferrari et al. | 16/382 |
| 5,195,214 | 3/1993 | Lautenschlager et al. | 16/DIG. 43 |

FOREIGN PATENT DOCUMENTS

| | | | |
|---|---|---|---|
| 833021 | 3/1952 | Fed. Rep. of Germany | 16/382 |
| 2149503 | 4/1973 | Fed. Rep. of Germany | 16/382 |

*Primary Examiner*—Carmine Cuda
*Attorney, Agent, or Firm*—Shlesinger Fitzsimmons Shlesinger

[57] ABSTRACT

A furniture hinge comprises a cup (12) which is flush-mounted in a door (17). The cup (12) comprises lateral protrusions (13, 14) having slots (15, 16) into which are inserted a shank with a button-shaped end (21, 22) protruding from the surface of the door (17) on either side of the housing (18) of the cup. The cup (12) is rotatable in the housing (18) from a first position in which the button-shaped ends fit into the slots (15, 16) to an operative or locking position with the wing (11) generically perpendicular to the edge of the door (17) and the button-shaped end locked in the slots (15, 16). A base (34) is provided for securing an articulated wing (11) of the hinge to the piece of furniture. Said base (34) comprises slots (47, 48) into which are inserted a shank (49, 58) of a button-shaped end (63, 64) protruding from the surface of the furniture. The base (34) is rotatable from a first position in which the button-shaped ends (63, 64) fit into their respective slots (47, 48) to an operative or locking position with the base (34) in a position in which it is coupled with the wing (11) and the button-shaped ends (63, 64) are locked in the slots (47, 48).

16 Claims, 4 Drawing Sheets

Fig.1
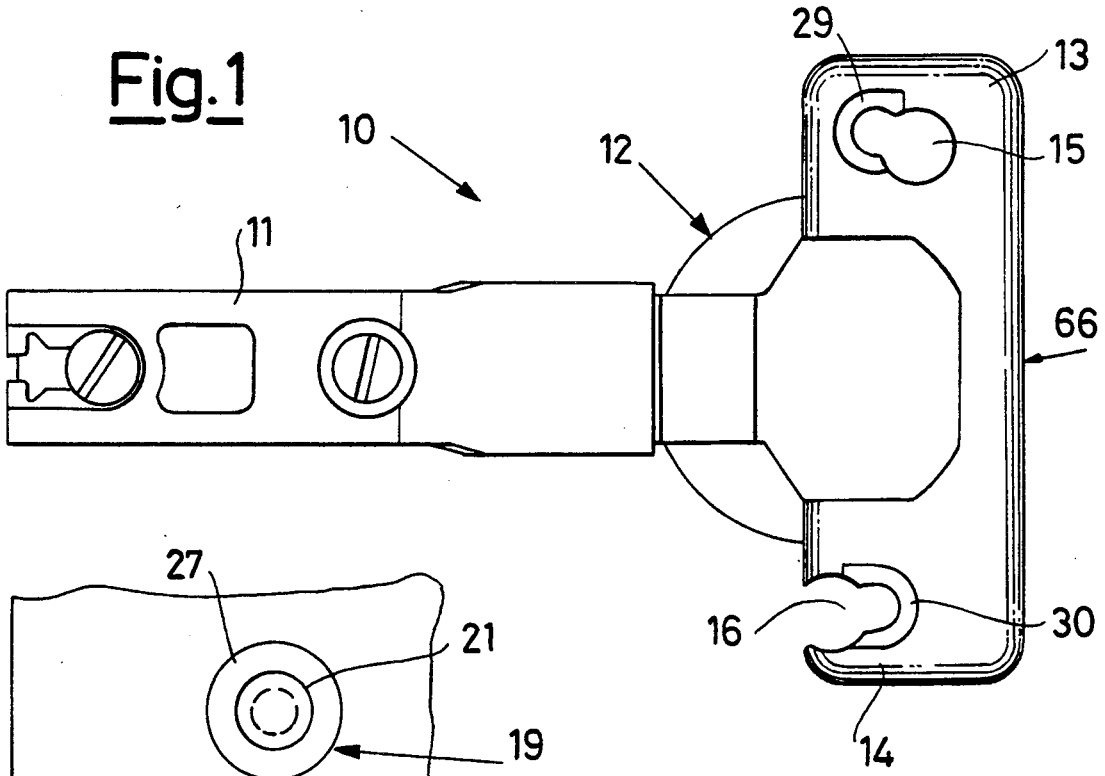
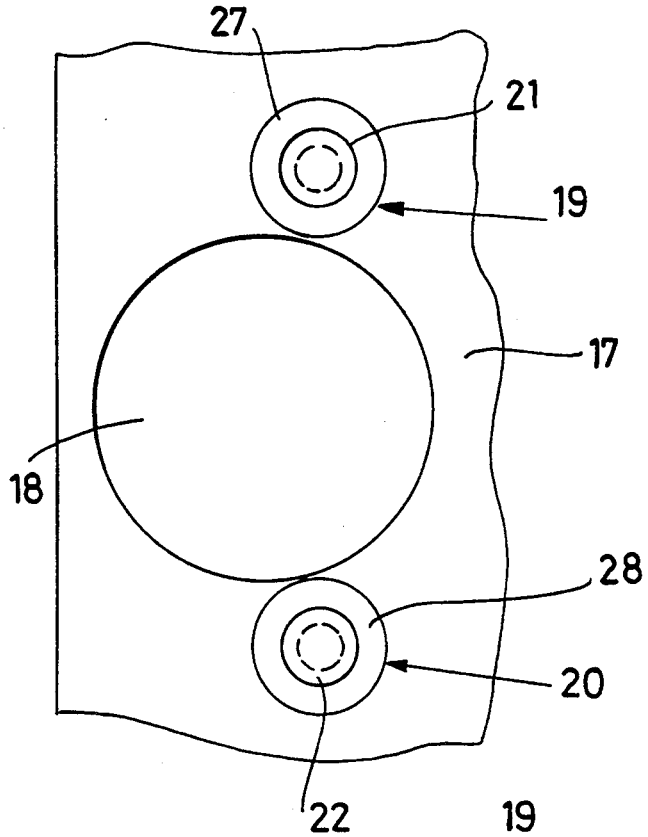
Fig.2
Fig.3
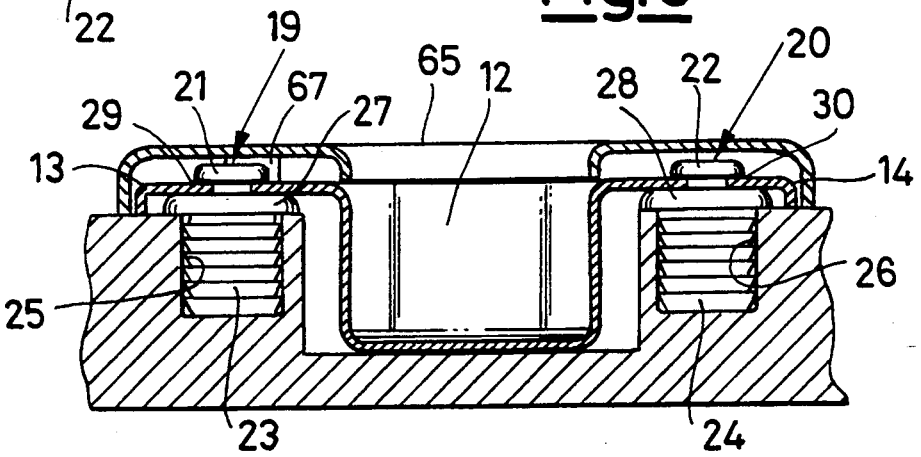

QUICK-COUPLING WING TYPE HINGE AND BASE

This invention refers to furniture hinges of the type composed of a wing hinged to a cup-shaped element which is secured to the door and a base which is secured to the side of the piece of furniture and to which said wing is subsequently coupled. In particular, this invention refers to a system for rapidly coupling the cup and the base to their respective parts of the furniture. It is now customary for furniture manufacturers to use production lines in which the bases are pre-fitted to the sides of the furniture and the hinge parts are pre-fitted to the doors long before the final assembly of the furniture. In particular, the bases are secured to the furniture, if necessary with the interposition of an adjusting mounting, by means of screws or normal or expansion plugs while the hinges are fixed onto the doors by securing the cup-shaped part (also by means of screws or normal or expansion plugs) to the inside of holes or recesses provided in the door itself. The base and cup-shaped part are often secured by means of automatic machines.

The doors are finally fitted onto the furniture by hand, by coupling the wings to the bases, at the end of the assembly line or even on the premises of the end user after having finally installed the piece of furniture. This procedure satisfactorily rationalizes the assembly operations by doing away with the need to secure the hinge elements during the final assembly of the furniture which, with the systems conventionally used, would require excessive time, especially whenever the assembling is carried out on the premises of the end user.

Unfortunately, however, pre-fitting the hinge elements constitutes a problem with regard to the handling and storage of the elements of the furniture in the form of panels to be subsequently fitted together. In fact, after the parts of the hinge have been secured to the doors and side panels of the furniture, the doors and side panels have to be handled with the utmost care in order to prevent the metal protrusions of the hinges from scratching the surface of the wood. Moreover, the panels can only be stacked by separating them from one another, by means of appropriate spacers, by a distance at least equal to the height of the hinges on them, which consequently doubles the height of the stack as compared to a stack of panels without hinges.

While no solutions have been proposed for these problems with regard to the bases to be secured to the side panels of the furniture, with regard to the hinges on the doors solutions have been proposed which are based on subdividing the cup-shaped portion of the hinge into two parts: a mounting or base of limited dimensions, which is pre-fitted to the door in the conventional way, and the actual cup bearing the articulated wing. In this way, the cup is secured by hand to the mounting during the final assembly. The cup is secured to the mounting by inserting it into a substantially cylindrical housing provided in the mounting in correspondence with the hole in the door and turning it so as to fit one or more notches made on the cylindrical surface of the cup into appropriate seats provided in the mounting. In addition to requiring a further element (the mounting), this solution also presents various structural problems.

In fact, the mounting is secured to the wood by means of fasteners (usually expansion-plugs or screws) positioned at centre distances necessarily greater than the diameter of the hole housing the cup. The fasteners securing the mounting to the wood are consequently situated at a distance from the fasteners securing the cup to the mounting. Hence, when pressure is exerted on the mounting (especially when it is made of plastic) it flexes and creates undesirable slack between the door and the piece of furniture. Moreover, there is a possibility that, in time, the continual bending movements may cause the mounting to split, and consequently cause the hinge to be suddenly disconnected from the door.

Moreover, due to the dimensions of the hole housing the cup (imposed by the dimensions of the articulation of the hinge and consequently not reducible beyond certain limits), a further problem of the known technique derives from the fact that the rotatory movement required to lock the cup on the mounting must be very wide and can cause the protruding portion of the hinge to accidentally come into contact with the outer edge of the door.

Consequently, care must be taken during assembly in order to prevent the metal part of the hinge from damaging the surface of the door.

The general scope of this invention is to obviate the aforementioned problems by providing an innovatory hinge with the possibility of rapidly and reliably securing the cup and the base to their respective furniture elements at any stage in the assembly cycle.

This scope is achieved according to the invention by providing a hinge for furniture doors comprising a cup which is flush-mounted in a housing close to one edge of the door, the cup being secured, by means of articulated arms, to a wing connecting it to a base secured to the piece of furniture, characterized by the fact that the cup comprises lateral protrusions provided with slots each with a portion for inserting and a portion for receiving a shank with a button-shaped end with a head larger than the width of the receiving portion, the button-shaped end protruding from the surface of the door on either side of the housing of the cup, the cup being rotatable in the housing from a first position in which it fits into the housing with the inserting portion of the slots close to the respective button-shaped end, to an operative or locking position with the wing generically perpendicular to the edge of the door and receiving portion of the slots receiving the shank of the respective button-shaped end. The scope is further achieved, according to the invention, by providing a base for securing to a piece of furniture an articulated hinge wing connected to a door, characterized by the fact of comprising slots each with a portion for inserting and a portion for receiving a shank with a button-shaped end with a head larger than the width of the receiving portion and protruding from the surface of the piece of furniture, the base being rotatable from a first position in which the button-shaped end fits into the inserting portion of the respective slots to an operative or locking position with the base in a position in which it is coupled with the wing and the receiving portion of the slots receiving the shank of the respective button-shaped end.

The innovatory principles of this invention and its advantages with respect to the known technique will be more clearly evident from the following description of a possible exemplificative embodiment applying such principles, with reference to the accompanying drawings, in which:

FIG. 1 shows a plan view of a first hinge element to be secured to a door;

FIG. 2 shows a view of a detail of a door prepared to be fitted with the element of FIG. 1;

FIG. 3 shows a partial cross-sectional view along the line III—III of FIG. 5;

Figure 4:
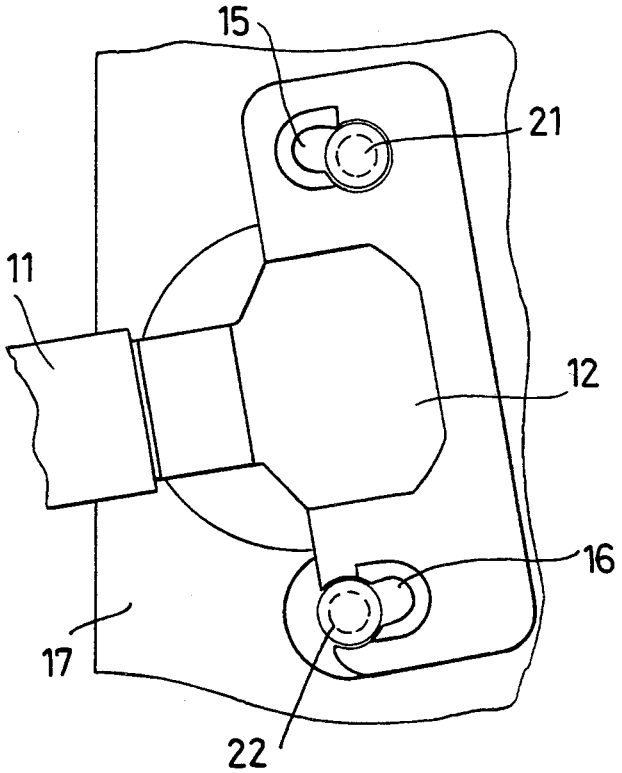
FIG. 4 shows a partial plan view of the element of FIG. 1 during a first phase of insertion for fitting on the prepared door of FIG. 2.

With reference to the figures, FIG. 1 shows a first portion of hinge 10 made according to the invention. Said portion 10 comprises a wing 11 hinged by means of articulated arms 62 (according to the known technique and consequently not shown in detail) to a cup 12 from which protrude laterally ends 13 and 14 of a fastening plate The ends 13 and 14 are provided with "keyhole"-shaped apertures or slots 15 and 16. In the embodiment shown, the narrowest portions of the apertures are aligned with each other on the perpendicular to the extension of the wing 11, while the wider portions are facing in opposite directions.

The cup 12 is shaped so as to be received in a hole or housing 18 made in a door 17, as schematically shown in FIGS. 2 and 3.

Generically, the axes of symmetry of the slots are directed according to tangents or arcs of circles with their centre in the axis of rotation of the cup in the housing 18.

Disposed substantially at the sides of the housing 18 on the door 17 are two fasteners 19, 20 with protruding "button"-shaped ends 21, 22 with heads larger in diameter than the narrowest portion of the apertures 15, 16, but smaller than the widest portions of said apertures. As can be clearly seen in FIG. 3, the fasteners 19 and 20 can advantageously be made in the form of expansion plugs having bodies 23, 24 with tapered ribbings which grip the insides of corresponding holes 25 and 26 made in the door 17. Each fastener has an annular protrusion 27, 28 which rests on the outer edge and limits its penetration into the hole 25, 26.

To fit the part 10 to the door 17, during the manufacture of the latter it is sufficient to make the holes 18, 25 and 26 and to secure the fasteners 19, 20 (if necessary, making use of known automatic machines). The door thus prepared (substantially appearing as in FIG. 2) can be easily handled and stacked due to the minimum protrusion of the fasteners 19 and 20. Moreover, especially if they are advantageously made of plastic, the fasteners 19 and 20 constitute a negligible danger of damaging the surfaces of the wood even in the event of them rubbing against it. Once the door has thus been prepared, at any preferred moment during the assembly of the piece of furniture, even on the premises of the end user, the wing element 10 of the hinge can be fitted onto it with a single rapid movement. In fact, as shown in FIG. 4, it is sufficient to position the cup so that it penetrates into the hole 18 and the button-shaped heads 21 and 22 pass through the widened portion of the holes 15 and 16. By rotating the wing so that it is positioned perpendicular to the edge of the door the two fasteners come to rest in the position shown in FIG. 5 and namely in correspondence with the narrower portion of the anchoring apertures 15 and 16, thereby securing the cup to the door.

Once the wing 11 has been secured to a respective base on the piece of furniture its reverse rotation is prevented and the part 10 of the hinge is therefore firmly locked in place.

Since the points in which the fasteners are secured to the door and to the cup substantially coincide it is obvious that no flexural movements leading to rupture are created, as occurs in the aforementioned known technique.

Figure 5:
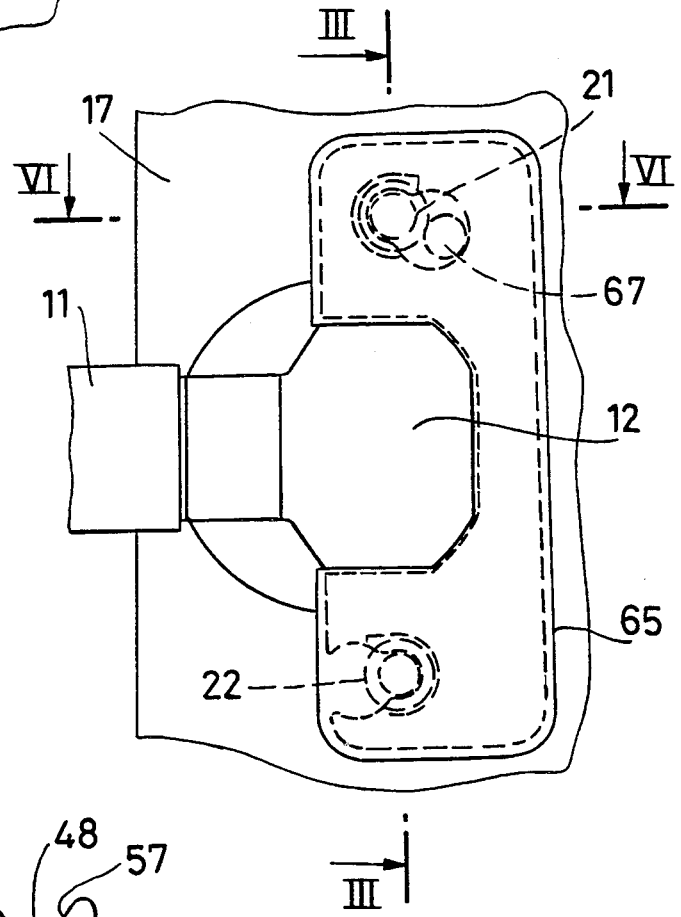
FIG. 5 shows a partial plan view of the element of FIG. 1 fitted onto the prepared door of FIG. 2.
Figure 6:
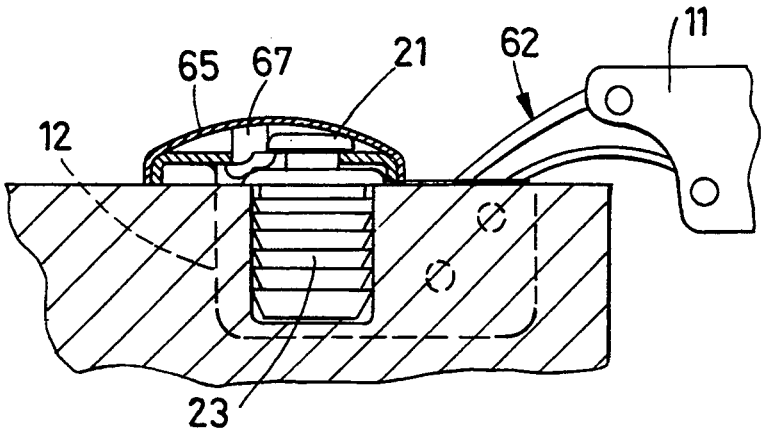
FIG. 6 shows a partial cross-sectional view along the line VI—VI of FIG. 5.

To improve the grip of the fasteners and eliminate any possible slack it is also advantageously conceivable to provide sloping surfaces 29, 30 around the narrow portion of the passages 15 and 16, so as to force the fasteners into said narrow portions and simultaneously thrust the protruding portion 13, 14 against the surface of the door. Advantageously, it is imaginable, as can be seen in FIGS. 3, 5 and 6, to provide a generically U-shaped casing 65 (for example, made of plastic) to cover the plate 66 so as to conceal the slots and the button-head fastening elements once the hinge has been secured in place.

Even though the rotation in the reverse direction to that of assembly is prevented once the wing 11 is secured to the piece of furniture, it is advantageously possible to provide further elements to prevent rotation in the reverse direction. For example, the cover 65 can be internally provided with a protrusion 67 which fits into the widened portion of the slot 15, and wedges itself between the edge of said widened portion and the button head 21, thus preventing rotation in the reverse direction even when the wing has not yet been fitted to the piece of furniture.

Figure 7:
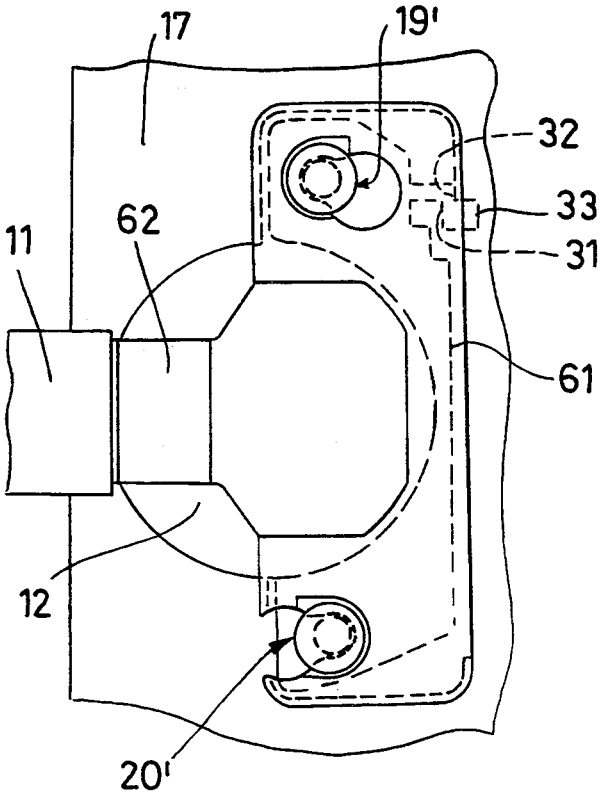
FIG. 7 shows a partial plan view of a possible alternative embodiment for fastening the first element.

Alternatively, as can been seen in FIG. 7, to achieve further action for preventing reverse rotation or detachment of the cup it is also possible to provide cup fasteners 19' and 20' connected together by a plate 61 bearing an elastically movable tab 31 which engages with an internal rabbet 32 on the portion securing the cup and thus prevent said reverse rotation. To remove the cup, the tab 33 is provided with s protruding control end 33 whereby the tab can be bent to disengage it from the rabbet 32.

Even though a hinge part 10 as described above can be used in conjunction with a suitable base secured to the piece of furniture by conventional techniques, the following description refers to a base applying the innovatory securing principles claimed herein.

Figure 8:
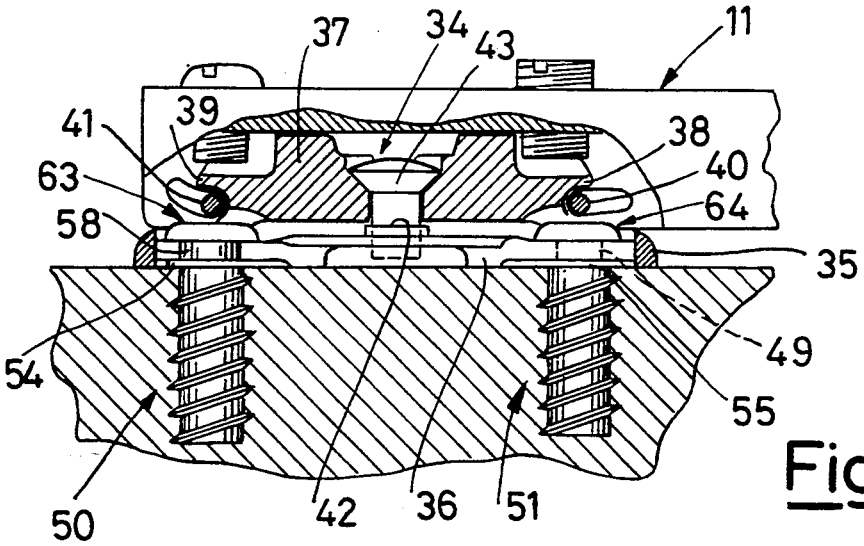
FIG. 8 shows a schematic partial cross-sectional side view of a second element or base of the hinge to be secured to the side panel of a piece of furniture and coupled to the first element of FIG. 1.

As can be seen in FIG. 8, said innovatory base 34 comprises a lower portion 35, which is hollow to receive a fastening plate 36, and an upper portion of block 37 which couples with the wing 11. The coupling between the wing 11 and base 34 can be of any known type. For example, the block 37 can be provided with teeth 38, 39 which fit into elastically movable pins 40, 41 on the wing. Such type of coupling is described in the Italian patent No. 215 532 on behalf of the same applicant and will therefore not be further described or shown.

The plate 36 is centrally provided with a seat 42 into which is screwed a screw 43 with its shank passing through a hole 44 in the base block 37. As can be clearly seen in FIG. 10, the hole 44 is oval to allow a known crosswise adjustment of the position of the base with respect to the fastening plate 36.

Figure 9:
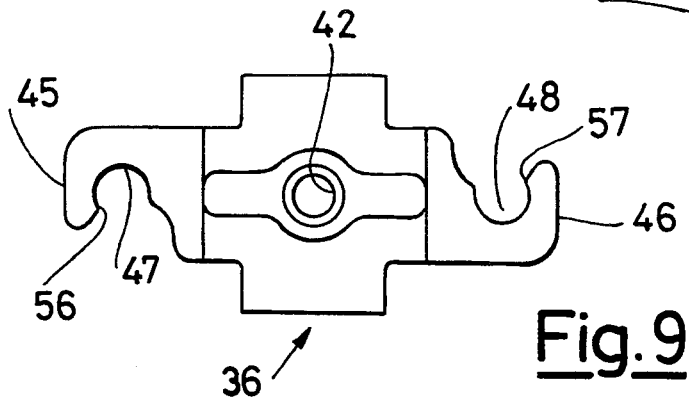
FIG. 9 shows a schematic plan view of a plate provided in the second element of FIG. 8.

As shown in FIG. 9, the plate 36 is generically shaped in the form of a cross with opposing arms 45 and 46 defining seats 47, 48 facing in opposite directions to receive, as will be explained further on, a narrow portion 58, 49 of a protruding button head portion 63, 64 of fasteners, for example composed of screws 50, 51.

Figure 10:
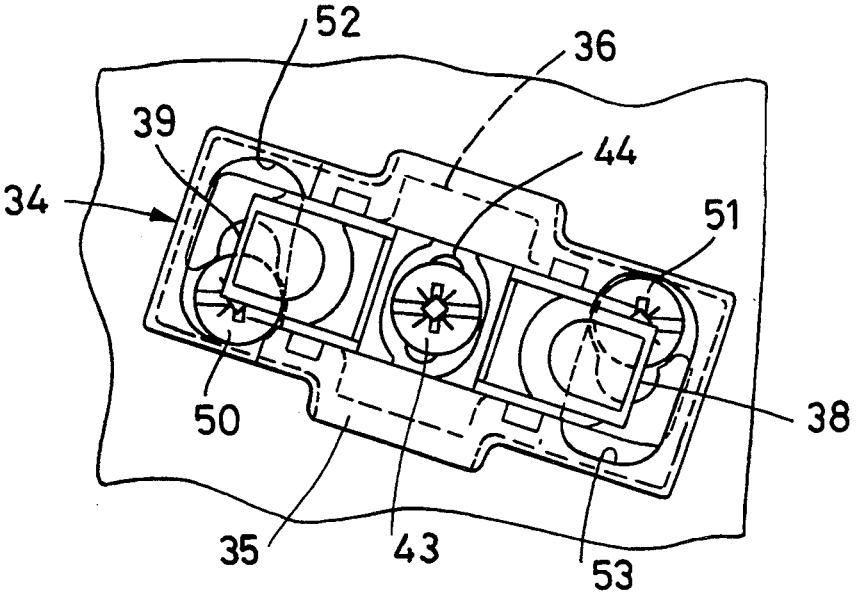
FIG. 10 shows a plan view of the base of FIG. 8 during a first phase of insertion for fitting it onto the piece of furniture.

As can be seen in FIG. 10, in correspondence with the seats 47 and 48 in the plate 36 the lower portion 35 of the base has upper elongated apertures 52, 55 to prevent interference of the heads of the screws 50, 51 with the body of the base.

In use, the screws 50, 51 are screwed into the side panel of the piece of furniture so that their circumferential edge 54, 55 comes into contact with the surface of the wood, thereby enabling the button-shaped portion of the heads of the screws to protrude by the correct amount as shown in FIG. 8.

Like the fasteners 19, 20, the screws 50 and 51 protrude by a minimum degree and consequently, for example, the thickness that must be inserted between the stacked panels is limited.

Figure 11:
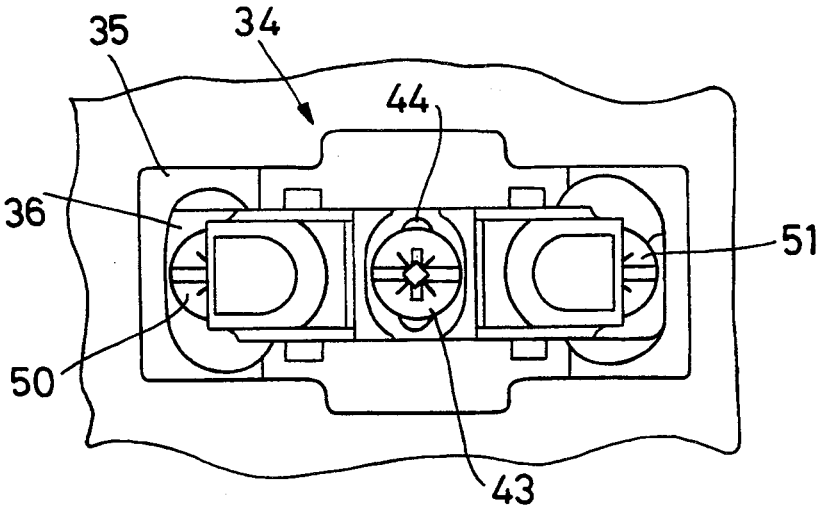
FIG. 11 shows a plan view of the based fitted onto the piece of furniture.

To fit on the base it is sufficient to position it as shown in FIG. 10, so that the protruding ends of the screws fit into the apertures 52, 53 close to the lateral entrance of the seats 47, 48. By rotating the base (in an anticlockwise direction in the figure) the grooves on the heads of the screws fit into the seats 47 and 48 thereby securing the base to the piece of furniture, as shown in FIG. 11. As can be seen in FIG. 9, the seats 47 and 48 can be provided with an inlet tooth 56, 57 which, by exploiting the elasticity of the ends of the plate 36, enables the grooves 58, 49 to snap tightly into place in the seats 47, 48.

By loosening the screw 43 it is then possible to adjust the crosswise position of the base.

Once the base has been fitted, the wing of the hinge can be coupled onto it, thereby hinging the door to the piece of furniture. The presence of the wing coupled onto the base prevents the base from rotating and disconnecting the screws 50, 51.

Whenever both the base and the cup of the hinge are made with quick couplings as described above, it is advantageous for the rotatory movements required to couple the base and the cup to be in opposite directions. In this way, when the wing is coupled onto the base the two elements of the hinge prevent each other from rotating, thereby ensuring that they are firmly secured.

Figure 12:
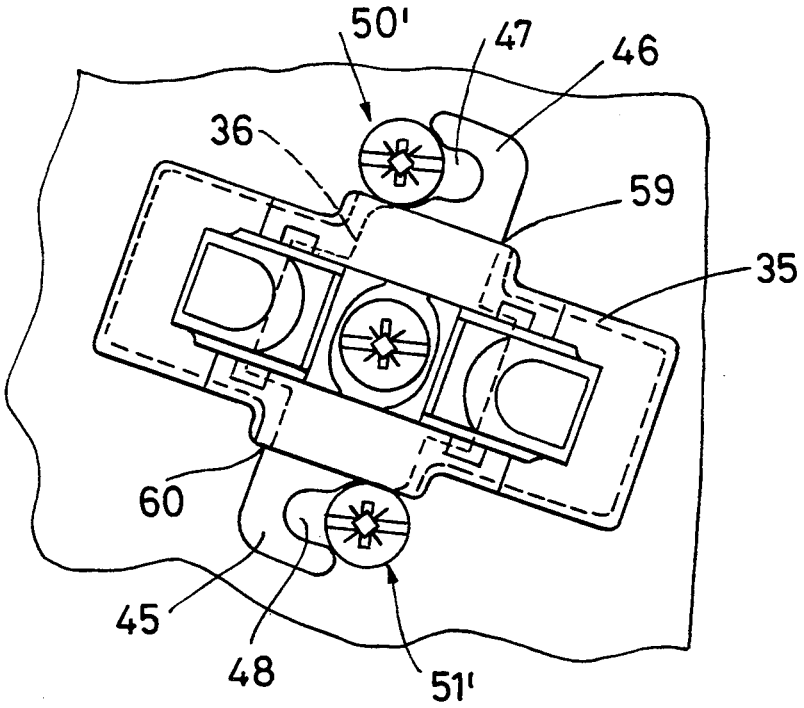
FIG. 12 shows a plan view of a possible alternative embodiment for fastening the base of FIG. 8.

As shown in FIG. 12, as a further possibility of securing the base, the lower portion 35 can be provided with lateral apertures 59, 60 so that the plate 36 can also be positioned rotated by 90° with respect to the base, so that the ends 45 and 46 protrude laterally from the base, leaving the fastening screws 50', 51' visible. Whenever this solution is preferred, the apertures 52, 53 in the base can be omitted.

At this point it will be clear that the intended scopes have been achieved, by providing hinge elements that can be quickly and reliably fitted onto the respective parts of the furniture.

The foregoing description of an embodiment applying the innovatory principles of this invention is obviously given by way of example in order to illustrate such innovatory principles and should not therefore be understood as a limitation to the sphere of the invention claimed herein. For example, although screw anchors are shown for fastening the cup and screws are shown for fastening the base, it is obvious that the fasteners can be made the same for either part of the hinge. Moreover, the use of normal screws can also be envisaged, each passing axially through a button-shaped washer.

Moreover, providing the slot 16 with a lateral aperture is not strictly necessary but is advantageous in order to keep the dimensions of the cup with its widened portion similar to those of normal screw-on cups of known technique.

Likewise, the slots 47 and 48 are open in order to keep the dimensions of the base similar to those of normal bases of known technique. It is possible, however, to make closed keyhole-shaped slots, as for the cup.

Conversely, whenever the dimensions of the hinge and the rotatory movement to fit the latter permit, the slots can also be made open and with a constant width (equal to the width of the shank of the button-shaped end) so that the button-shaped ends fit into slot from the open end of the slot only by rotatory movement of the hinge.

Whenever the slots are of a relatively great length, they will obviously be made substantially in the form of an arc of a circle with its centre in the centre of rotation of the cup, so as to enable the shanks of the button-shaped ends to slide smoothly along them.

The expert technician can also envisage means for preventing reverse rotation different from the one shown in FIG. 7. For example, use can be made of a plate having an upper protrusion which fits into a corresponding hole in the plate securing the cup.

If crosswise adjustment of the base is not required or achieved otherwise, the plate 36 can be eliminated and the seats 47, 48 made directly in the body 35.

Lastly, the number of button-head fastening elements and respective housings may differ from two, for example according to the required fastening force.

We claim:

1. In a hinge for furniture doors having a cup (12) which is disposed to be flush-mounted in a recess (18) formed in the surface of a door (17), close to one edge thereof, the cup (12) being secured, by means of articulated arms (62), to a wing (11) connecting it to a base (34) secured to a piece of furniture, the cup (12) having thereon lateral protrusions (13, 14) which overlie said surface of the door and which are provided with slots (15, 16) each having an enlarged first portion for permitting insertion of the head (21, 22) of a pin element (19, 20) and a second, narrower portion for receiving a reduced diameter shank portion of a pin element (19, 20) the head (21, 22) of each of said elements (19, 20) being larger in diameter than the width of said second portion of a respective slot, the head (21, 22) of each of said elements being secured to and spaced from the surface of the door (17) on either side of said recess (18) in the door, the cup (12) being coaxially rotatable in the recess (18) from a released position in which it fits into the recess (18) with the heads (21, 22) of the elements registering with the enlarged portions of the slots (15, 16), to an operative or locked position with the wing (11) disposed generally perpendicular to the edge of the door (17), and with the narrower portions of the slots (15, 16)

receiving therein the reduced diameter shank portion of the respective pin element (19, 20), and wherein the improvement comprises a cover (65) secured over said cup and said lateral protrusions and having engaging means for engaging the cover to the cup (12), the cover (65) having thereon interfering means positioned to interfere with at least one pin element of said elements (19, 20) for preventing rotation of the cup (12) from its operative position to its released position.

2. Hinge as claimed in claim 1, characterized by the fact that each pin element (19, 20) is provided with an enlarged diameter shank portion (23, 24) which engages in the door (17).

3. Hinge as claimed in claim 2, characterized by the fact that the enlarged diameter shank portion of said pin element (19, 20) is threaded to enable it to be screwed into the door (17).

4. Hinge as claimed in claim 2, characterized by the fact that the enlarged diameter shank portion of each pin element (19, 20) has circumferential ribbings (23, 24) to enable it to fit by pressure into a hole (25, 26) in the door (17).

5. Hinge as claimed in claim 1, characterized by the fact that the pin elements (19, 20) mutually comprise an interconnecting plate (61).

6. Hinge as claimed in claim 1, characterized by the fact that at least one of said slots (15, 16) is shaped in the form of a "keyhole", with a widened area having greater dimensions than the pin head (21, 22) to constitute said first portion for accommodating the latter.

7. Hinge as claimed in claim 1, characterized by the fact that said first portions of the slots (15, 16) have a raised edge (29, 30) inclined towards the associated pin head (21, 22) to enable the cup (12) to react against the door (17) when it is shifted to its operative position.

8. Hinge as claimed in claim 6, characterized by the fact that said interfering means is a pin (67) protruding inferiorly from the cover (65), said pin (67) fitting between the edge of the widened portion of the keyhole-shaped slot (15) and associated pin head (21) in it, so as to prevent movement of the pin head in the enlarged portion.

9. Hinge as claimed in claim 1, said base comprising slots (47, 48) each having a portion for inserting and a portion for receiving a shank (49, 58) of a pin (50, 51) with a head (63, 64) larger than the width of the receiving portion and protruding from the surface of the piece of furniture, the base (34) being rotatable from a first position for inserting the pin (50, 51) in the inserting portion of the respective slots (47, 48) to an operative or locking position with the base (34) in a position in which it is coupled with the wing (11) and the receiving portion of the slots (47, 48) receiving the shank of the respective pins (50, 51), the directions of rotation from the inserting position of the cup (12) and base (34) are opposed to each other.

10. Hinge as claimed in claim 9, characterized by the fact that the slots (47, 48) in the base (34) are made in a plate inferiorly secured to a block (37) connecting it to the wing (11).

11. Hinge as claimed in claim 10, characterized by the fact that the slots (47, 48) in the base (34) open out towards opposite side edges of the plate (36) to form the inserting portions.

12. Hinge as claimed in claim 10 characterized by the fact that the plate (36) is secured to the block (37) by means of a screw (43) screwed onto the plate (36) and with its shank passing through a seat (44) in the block (37), the seat 44 being elongated crosswise to the base (34) to permit crosswise adjustment of the reciprocal position between the plate (36) and block (37) when the screw (43) is loosened.

13. Hinge as claimed in claim 10, characterized by the fact that the plate (36) is generically shaped in the form of a cross, the slots (47, 48) being provided on opposing arms (45, 46) of the cross.

14. Hinge as claimed in claim 9, characterized by the fact that each of said pins (50, 51) is provided with a shank which fits into the piece of furniture.

15. Hinge as claimed in claim 14, characterized by the fact that said shank of each of said pins (50, 52) is threaded so as to be screwed into the piece of furniture.

16. Hinge as claimed in claim 14, characterized by the fact that said shank of each of said pins (50, 51) has circumferential ribbings to enable it to fit by pressure into a hole in the piece of furniture.

* * * * *